US005363898A

United States Patent [19]

Sprague

[11] Patent Number: 5,363,898

[45] Date of Patent: Nov. 15, 1994

[54] COUNTERBALANCED FLEX WINDOW

[76] Inventor: Harry F. Sprague, 10 Wapping Rd., Kingston, Mass. 02364

[21] Appl. No.: 103,566

[22] Filed: Aug. 9, 1993

[51] Int. Cl.[5] ..... E06B 3/32

[52] U.S. Cl. ..... 160/98; 160/191; 160/207

[58] Field of Search ..... 160/98, 187, 207, 191, 160/192; 49/445, 446; 16/197, 198, 199, DIG. 16

[56] References Cited

U.S. PATENT DOCUMENTS 2,330,696 9/1943 Exiner .
2,408,739 10/1946 Dawes .
2,771,133 11/1956 Haskell .
4,039,018 8/1977 De Maria ..... 160/187 X
4,227,345 10/1980 Durham ..... 49/445 X
4,683,676 8/1987 Sterner .
4,935,987 6/1990 Sterner .

*Primary Examiner*—David M. Purol
*Attorney, Agent, or Firm*—Samuel M. Learned, Jr.

[57] ABSTRACT

A counterbalanced flex window wherein the sashes thereof, being joined together by a hinge, flex and fold toward each other when the window is released for opening and thereafter automatically maintain randomly adjusted open positions without the need for supplemental manually engaged incremental adjustment latch devices.

6 Claims, 5 Drawing Sheets

10
38
69
70t
16T
74
54
72t
44
34
48
26
28
26
12
62
32
42
64
62
40
16I
46
44
80
20
82
90
56
84
22
16E
16
86
44
26
66
40
66
50
26
14
42
68
46
24
44
72b
70b
74
69
16B

COUNTERBALANCED FLEX WINDOW

BACKGROUND OF THE INVENTION

The present invention relates to a counterbalanced flex window adapted to be opened by means of the sashes thereof flexing and foldably closing upon themselves about a joining hinge. The advantage of such a window, when sashes thereof are releasable from both the top and bottom, is that one may position the same so as to enable access from inside to clean both the interior and exterior surfaces of the window sash panes.

Exemplary of flex window teachings are those as set forth in U.S. Pat. No. 2,330,696 to Exiner dated Sep. 28, 1943, and U.S. Pat. No. 2,771,133 to Haskell dated Nov. 20, 1956. As is typical of prior art flex window structures, however, and as respectively shown in each of the foregoing references, some sort of a mechanical holding or latching means is necessary to retain set of the foldably opened sashes of a flex window in an opened position as opposed to the employment of a conventional counterbalancing means. In both Exiner and Haskell mechanical locking devices are employed to hold the foldably opened sashes in a fixed position. On the other hand, in a teaching by Dawes in U.S. Pat. No. 2,408,739 dated Oct. 8, 1946, the flex window sash is not only foldably opened and operated, but held as well also in a fixed position by means of a pivotally connected threaded collar vertically driven by a crank operated cooperative threaded shaft.

A cam operated balance shoe of that type typically illustrated and described in U.S. Pat. No. 4,683,676 to Sterner, Jr., dated Aug. 4, 1987, in combination with the constant force counterbalance coil spring application as typically described and taught in U.S. Pat. No. 4,935,987 Sterner, Jr., dated Jun. 26, 1990, are similar to those generally like components employed by the instant applicant, in combination one with the other and with a flex window structure, in order to provide the automatic counterbalance and opening set capabilities as herein taught.

As contrasted to the foregoing, applicant herein by his invention provides a convenient new and novel means for counterbalancing a flex window so the same may be opened and set at any random position within the range thereof without a need for use of supplemental mechanical hardware means for effecting positive latch engagement and retained sash set at one of a limited range of predetermined positions.

SUMMARY OF THE INVENTION

The principal object of the present invention is to provide a counterbalanced flex window with the sashes thereof joined together by a suitable hinge to thereby permit outward flexing action where joined with the inside faces of the sashes folding toward each other at a desired angle when the window is moved from an extended closed position to a flexed open position.

It is another object of the present invention to provide a counterbalanced flex window which incorporates a coil spring counterbalance means for automatically maintaining the flexed open bottom sash thereof in randomly adjusted open positions without the need for supplemental manually engaged incremental adjustment latch securement means.

An additional object of the present invention is to provide a counterbalanced flex window wherein the top sash thereof, when released for vertically slidable displacement, is auomatically retained in a randomly adjusted open position by means of a cam operated frictional balance shoe means.

Still another object of the present invention is to provide a counterbalanced flex window having adjustment features which enable sash positioning from a closed mode to an opened vent mode.

It is a further object of the present invention to provide a counterbalanced flex window having adjustment features which enable sash positioning from either a closed mode or an opened vent mode to a cleaning mode.

Yet another object of the present invention is to provide a counterbalanced flex window which, when positioned in the cleaning mode, permits cleaning of both the interior and exterior surfaces of both window sashes from inside the room.

It is also an object of the present invention to provide a counterbalanced flex window which incorporates a retractable screen for preventing the entry of insects when the window is positioned in the vent mode.

The foregoing, and other objects hereof, will be readily evident upon a study of the following specification and accompanying drawings comprising a part thereof.

DETAILED DESCRIPTION OF THE INVENTION

Figure 1:
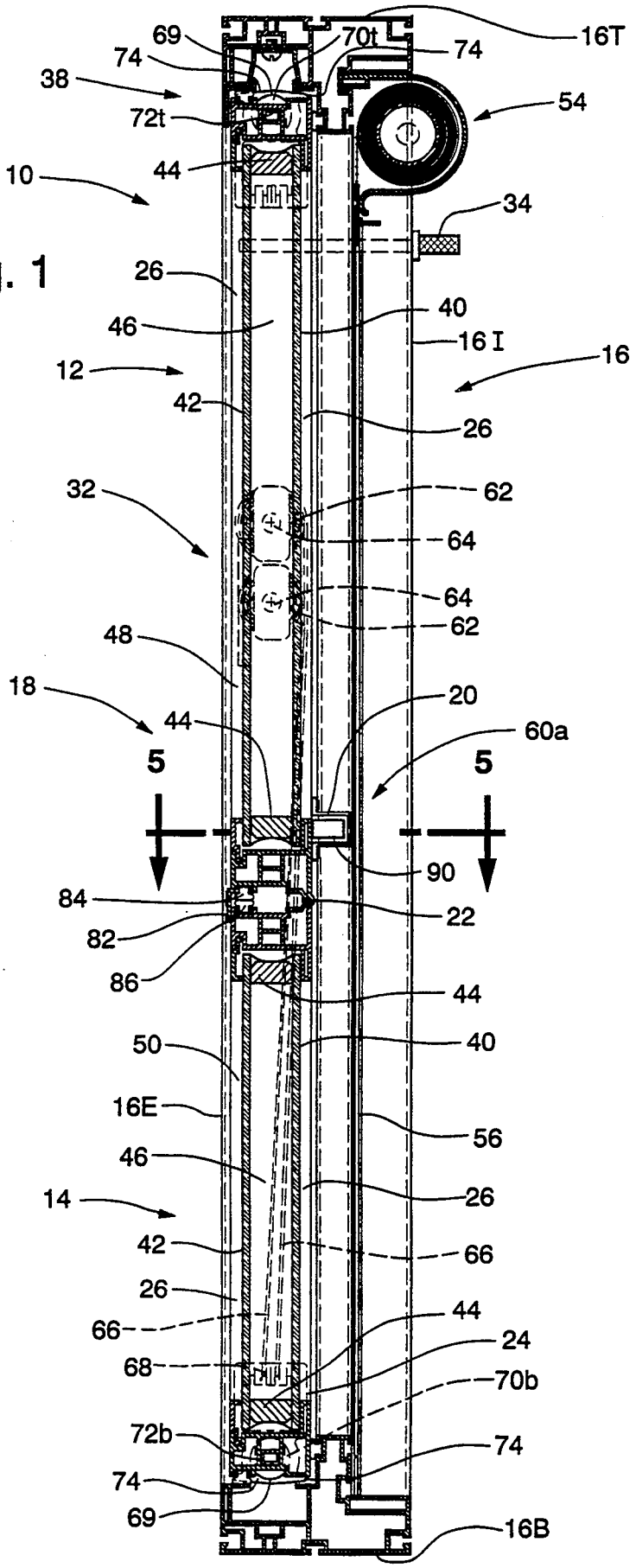
FIG. 1 is a vertical side elevation sectional view through a counterbalanced flex window of instant invention, showing the same in an extended closed and latched position.
Figure 2:
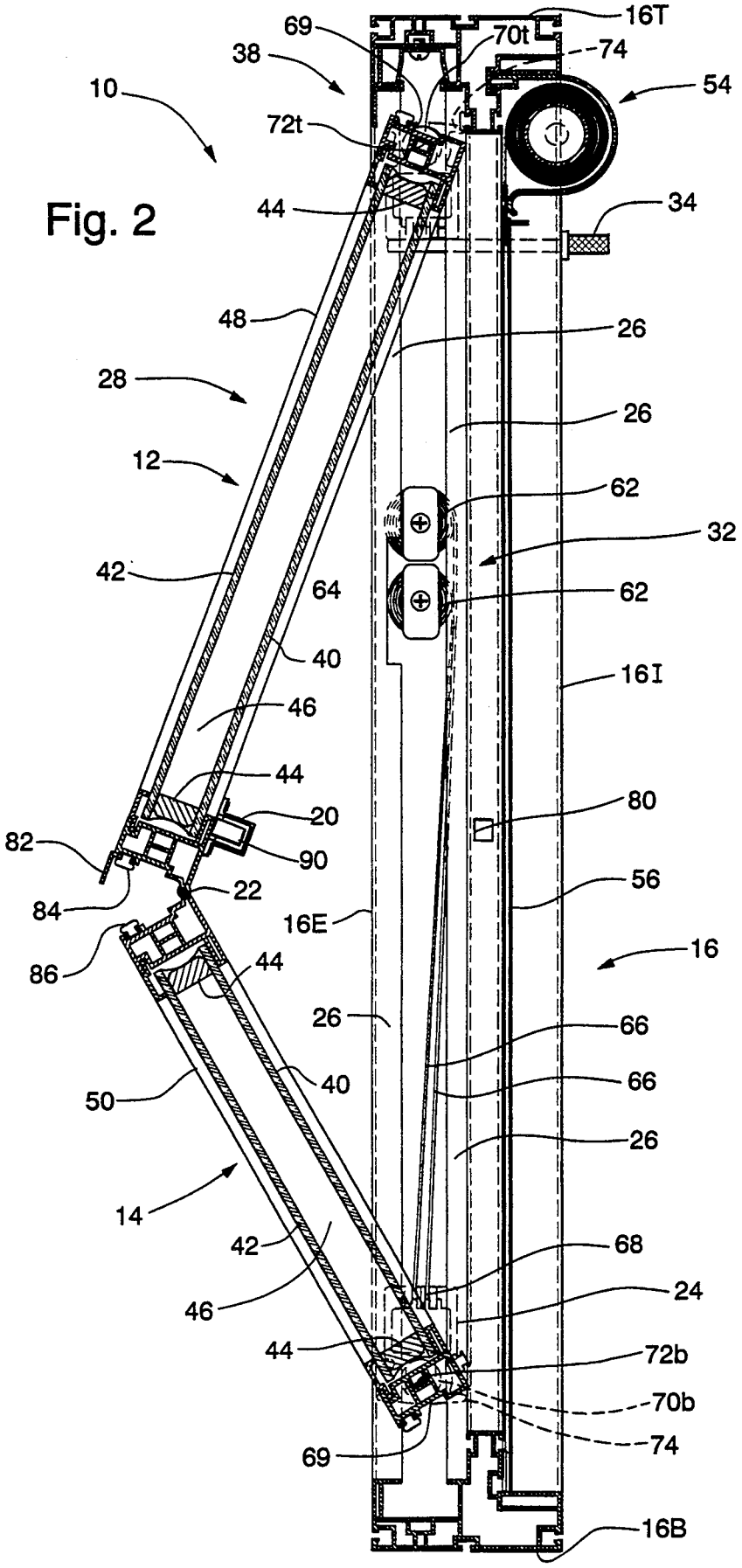
FIG. 2 is a vertical side elevation sectional view of said window similar to that as previously shown, but with the latching mechanism thereof released and the bottom sash flexed upward to a randomly adjusted open position.
Figure 3:
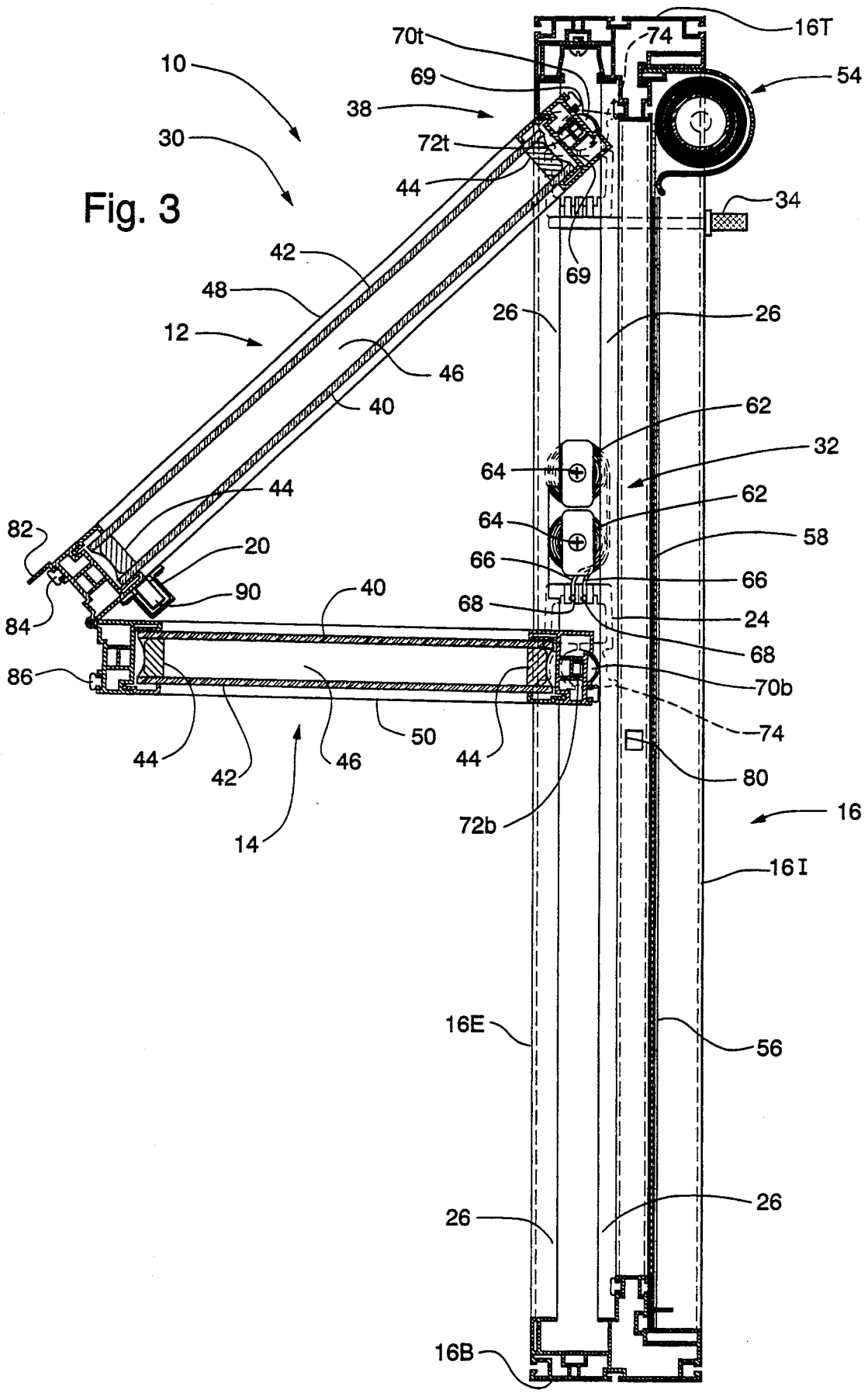
FIG. 3 is a vertical side elevation sectional view of said window similar to that as previously shown but with the bottom sash thereof further flexed upward to the opened vent mode position and the retractable screen thereof pulled down.
Figure 4:
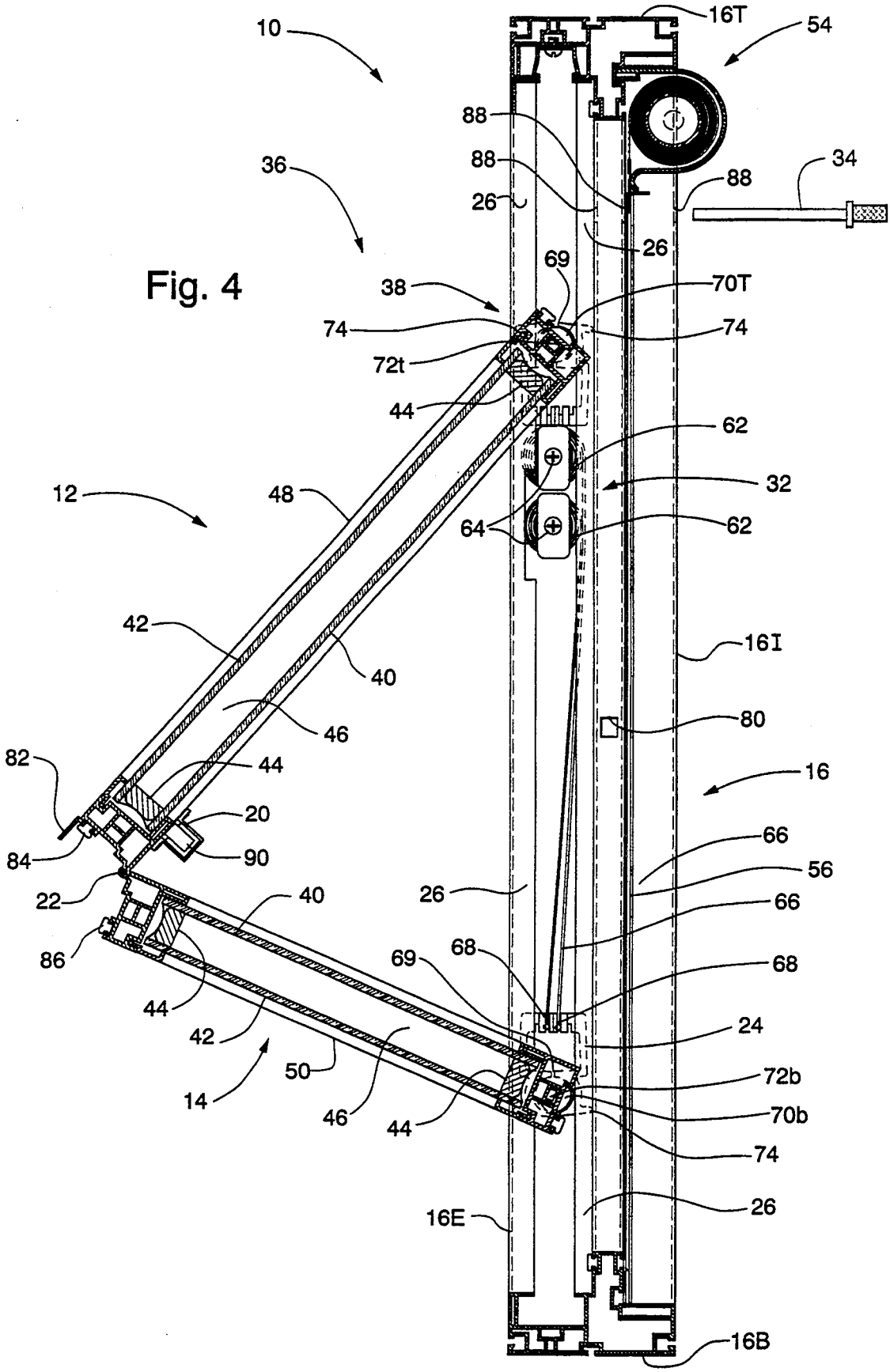
FIG. 4 is a vertical side elevaation sectional view of said window similar to that as previously shown, but with the top sash thereof released for vertically slidable displacement to the cleaning mode position and the screen thereof in the retracted and stowed position.

Referring to FIG. 1 the counterbalanced flex window 10 of present invention is shown in double hung profile in a vertical side elevation sectional view to illustrate the major structural components thereof, being a top sash 12 and a bottom sash 14 cooperatively set within a window frame structure 16 and therein secured in an extended closed position 18 as shown by means of a latching mechanism 20, wherein the bottom sash 14 when pivotally moved about the sash frame joining hinge 22 relative to the top sash 12 displaces vertically by means of movement of the bottom sash shoe 24 upwardly within the frame structure tracks 26 to a randomly adjusted flexed open position 28 as hereinafter shown and described on a consideration of FIG. 2, or the vent mode position 30 as shown in FIG. 3, and is automatically maintained in those positions by means of the coil spring counterbalance assembly 32, as well as when the top sash 12 is concurrently released for displacement to an adjusted open position by retraction of the top sash retaining pintle 34 to allow for vertical downward movement thereof within the frame structure 16 pivotally about the hinge 22 relative to the bottom sash 14 to the cleaning mode position 36 as shown in FIG. 4, wherein the top sash 12 is maintained in the opened cleaning mode position 36 relative to the bottom sash 14 by means of a cam operated frictional balance shoe 38 cooperatively operable with said coil spring counterbalance assembly 32 and said bottom sash shoe 24.

Referring again to FIG. 1 to consider in greater detail the cooperative structural aspects of said counterbalanced flex window 10 and the operation thereof, wherein it will be noted that the top and bottom sashes 12 and 14 are of typical double-pane insulated construction respectively having an interior and exterior pane 40 and 42 separated by insulation spacers 44 with an insulating dead air space 46 therebetween, each of which in turn is respectively contained within a top and bottom sash frame 48 and 50. It will also be noted that although the top and bottom sashes 12 and 14 are of the same width dimension, the top sash 12 is of a nominally longer vertical dimension than that of the bottom sash 14 in order to accommodate more suitable the various opened profile sets of said counterbalanced flex window 10 as will hereinafter be more fully described and explained.

In the extended and closed position 18 as shown in FIG. 1, the top and bottom sashes 12 and 14 are stacked on vertical alignment within the window frame structure 16, wherein 16T designates the top of the window frame, 16I the building structure interior or inside face thereof, 16B the window frame bottom, and 16E the building structure exterior or outside face thereof. Thus, all manipulations and adjustment sets of the window 10 from the extended closed position 18 as shown in FIG. 1 to various of the opened positions as hereinafter described would be accomplished by a person situated inside on the 16I building structure interior of that building in which said window 10 was installed. Also included as a component assembly for use when the window 10 is profiled in the vent mode position 30 is a retractable screen 54 with a screen retaining guide track 56 which is adapted to maintain the drawn screen 58 as shown in FIG. 3 in a secure insect barrier profile when in use.

Figure 5:
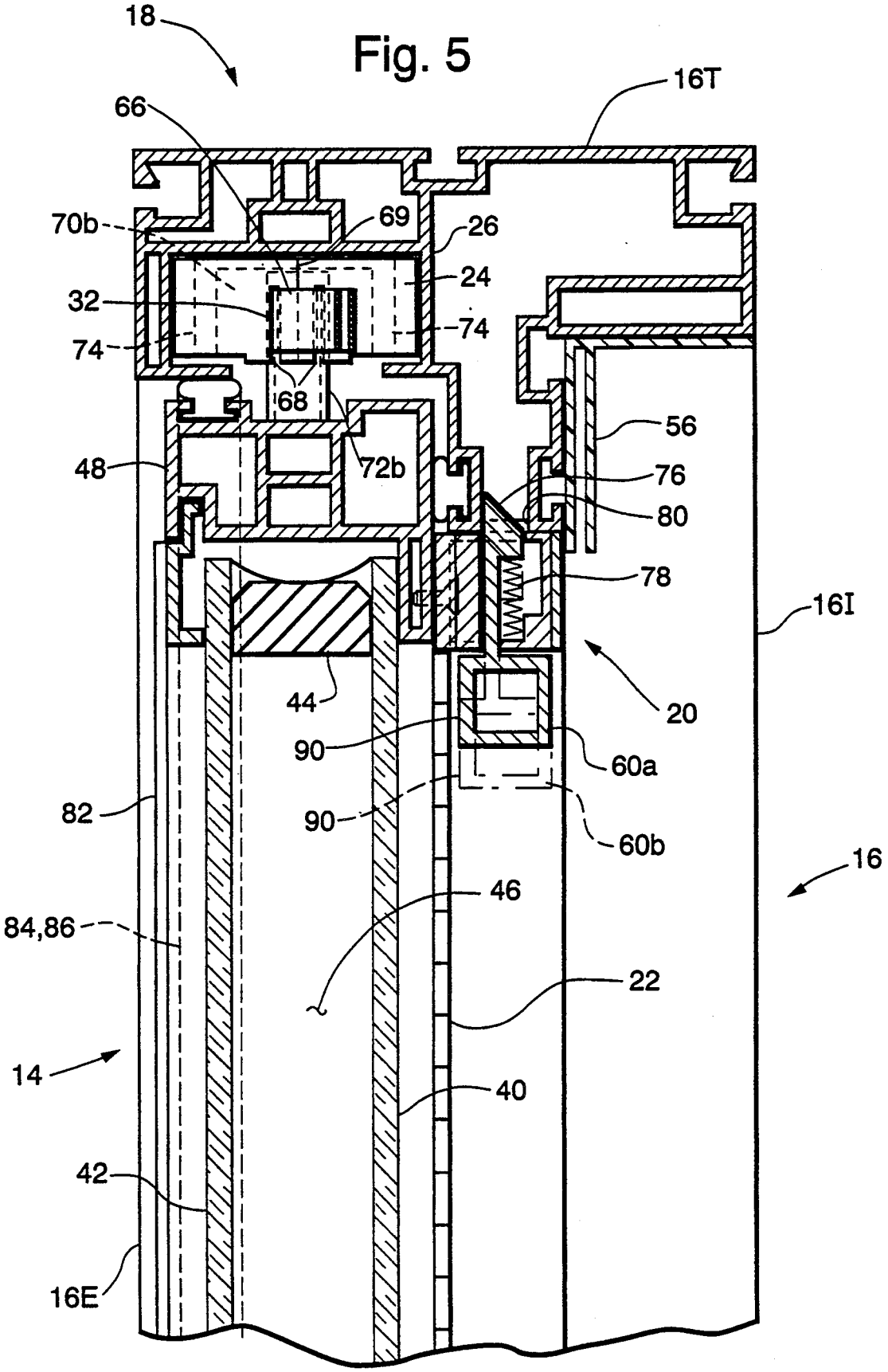
FIG. 5 is an enlarged top sectional view through the latching mechanism of said window, as shown in FIG. 1 and seen along the line 5—5 thereof.

Turning again to FIG. 1 for a more detailed consideration of the cooperative working components of the counterbalance flex window 10, and considering first the coil spring counterbalance assembly 32 which operates primarily to automatically counter-balance the bottom sash 14 when the latching mechanism 20 is manually moved from the latch keeper position **60*a* to the latch release position 60*b* as shown in FIG. 5, and the window 10 is thereafter manually profiled from the extended closed position 18 as shown in FIG. 1 to any of the previously mentioned opened positions 28, 30, or 36. As illustrated, the coil spring counterbalance assembly 32 for the bottom sash 14 in this exemplary case is comprised of two constant force counterbalance coil springs 62, wherein the specific number of such coil springs 62, whether one or more, is determined by the individual coil spring 62 ratings and that total number of such springs either individually or cumulatively necessary to counterbalance the bottom sash 14 cooperatively with the top sash 12 in any of the various window 10 opened profile position possibilities. Attachment of the coil springs 62 is by means of screws 64 installed by threadable engagement to the window frame structure 16 in close insertable support of said springs 62 respectively through the core openings thereof. Thereafter, the respective coil spring ribbons 66 are extended and the ends thereof slidably installed within the coil spring ribbon attachment slots 68 of the bottom sash shoe 24**.

It will be noted that the bottom sash shoe 24 has a split 69 within which operates an eccentric rotary cam **70*b* keyed to receive and be driven by a cam shaft 72*b* which is installed to the lower end of the bottom sash frame 50 such that when the window 10 is profiled in an opened position the bottom sash at the upper end thereof pivotally moves about the sash frame joining hinge 22 relative to the top sash 12 and the bottom sash shoe vertically desplaces upward as guided by and within the frame structure track 26 whereby the bottom sash shoe cam shaft 72*b* is rotated to drive the bottom sash shoe eccentric rotary cam 70*b* and thereby incrementally expand the split bottom sash shoe 24 so that the balance shoe feet 74 thereof opposingly outward engage the frame structure tracks 26 and frictionally stabalize the bottom sash 14 at an automatically counterbalanced opened position relative to the flexed and folded profile thereof in relation to the top sash 12, the foregoing operation of which is more clearly shown in FIGS. 2 and 3** and will be more fully explained on subsequent detailed considerations of these Figures.

The cam operated frictional balance shoe 38 structure and operation thereof upon withdrawal of the top sash retaining pintle 34 to provide automatic counterbalancing of the top sash 12 is similar to that of the bottom sash shoe 24, as will be more fully explained hereinafter on a detailed consideration and explanation of FIG. 4.

The counterbalanced flex window 10 as shown and illustrated in FIG. 1, and certain subsequent Figures hereinafter, may be cast, extruded or machined and fabricated from various metals and alloys thereof, or plastics, or combinations of metals and metal alloys and plastics by methods and techniques commonly employed in such operations.

Referring now to FIG. 2 and the randomly adjusted flexed open position 28 profile of the counterbalanced flex window 10 to more fully explain the opening and automatic counterbalanced operation features thereof.

In order to move the window 10 from an extended and closed position 18 as shown in FIG. 1, which is the locked and secured profile thereof, and articulate the same into a randomly adjusted flexed open position 28 as shown in FIG. 2, it is necessary to disengage the latching mechanism 20 from the latch keeper position **60*a* as shown in FIG. 5 to the latch release position 60*b*, thereby laterally displacing the latch keeper lug 76, against closing force of the latch compression spring 78, past the edge of the keeper lug retention opening 80 and thus mechanically releasing both the top and bottom sashes 12 and 14 to pivotally fold toward each other about the sash frame joining hinge 22 as the bottom sash shoe 24 of the bottom sash 14 is moved vertically upward within confines of the frame structure tracks 26. At this stage, automatic counterbalancing of the window 10 when opened to a randomly adjusted flexed open position 28 as exemplary shown in FIG. 2 is achieved by means of upward balance effected by the constant force counterbalance coil springs 62 communicating through the coil spring ribbons 66 in operating against the downward cumulative force effects primarily of the bottom sash 14 and that additional incremental downward force vector contributed by the top sash 12 minus the frictional drag effect of the balance shoe feet 74 compressively engaged against the frame structure tracks 26 as the bottom sash shoe 24 displaces vertically upward within said tracks 26 upon the opening of said window 10 in the manner instantly described and the bottom sash shoe eccentric rotary cam 70*b* is rotated by the bottom sash cam shaft 72*b* to deflect said feet 74 laterally outward. When manual movement of the window 10 to a randomly adjusted flexed open position 28 is accomplished as above described, then whatever random open position is thus set is automatically maintained by mechanical balance of the sashes 12 and 14 against the constant force counterbalance coil springs 62 and held in set position by frictional engagement of the bottom sash shoe feet 74 with the frame structure tracks 26. It should be noted that compensation for the changing downward counterbalance force profile upon random flex adjustment of the lower sash 14 is accommodated by means of operation of the bottom sash shoe eccentric rotary cam 70*b* as it is rotated upon vertical opening of closing displacement of the bottom sash 14 which increases or decreases the frictional drive effect on the feet 74 in increased or decreased force of engagement with the frame structure tracks 26, being more clearly shown when the counterbalanced flex window 10 is adjusted to the vent mode position 30 as illustrated in FIG. 3**.

Additionally shown in greater clarity and detail in FIG. 2 are the closure sealing and insulation means for the top and bottom sashes 12 and 14 when profiled in the extended closed position 18 as shown in FIG. 1, wherein sash closure sealing is provided by the sash closure sealing apron 82 and insulation in closure by mutually compressive engagement of the top and bottom sash closure insulation gaskets respectively 84 and 86.

Turning attention now to FIG. 3, wherein is shown adjustment set of said window 10 in the vent mode position 30. As the base of the bottom sash 14 is displaced vertically upward to the maximum elevation as shown, which is when the counterbalance coil spring ribbons 66 are fully retracted and the bottom sash shoe 24 continued vertical upward displacement is blocked by the coil springs 62, the the window 10 has been articulated to the vent mode position 30. At this point the maximum arcuate displacement of the bottom sash shoe eccentric rotary cam **70*b* as shown in FIG. 3, and as driven by rotation of the bottom sash shoe cam shaft 72*b* as previously described, has been achieved and the vent mode positioning 30 of said window 10 is held in the set position by maximum outward frictional engagement of the balance shoe feet 74 with the frame structure tracks 26. In the vent mode position 30 configuration it will be noted that the top sash 12 pivotally flexes about the sash frame joining hinge 22 foldably toward the bottom sash 14, but does not per se vertically displace within the frame structure tracks 26 since the cam operated balance shoe 38 therefor is blocked to downward vertical displacement by the frame inserted top sash retaining pintle 34 and the upper end of the top sash 12 merely pivotally deflects in place by means of rotation of the top sash shoe cam shaft 72*t* within the eccentric rotary cam 70*t***.

Also shown in FIG. 3 is utilization of the retractable screen 54 wherein the drawn screen 58 functions as an insect barrier when the window 10 is profiled in the opened vent mode position 30.

Turning now to a consideration of the cleaning mode position 36 of said window 10 as illustrated in FIG. 4, which is that window 10 adjustment profile to enable cleaning of the interior and exterior sash panes 40 and 42 thereof from the window frame interior 16I side, wherein automatic counterbalanced articulation and set of the bottom sash 14 adjustment profile in this case is as was previously described. With respect to the top sash 12 vertical displacement adjustment profile, however, in order to facilitate access to the exterior pane 42 thereof from the window frame interior 16I side for purposes of cleaning, the top sash retaining pintle 34 must be withdrawn from the frame structure pintle retaining openings 88 therefor so that the top sash cam operated frictional balance shoe 38 is thereby released for guided vertical downward displacement within the frame structure tracks 26 as shown in FIG. 4. In a like manner, as is with the bottom sash shoe 24, the cam shaft **72*t* affixed in this case to the upper end of the top sash 12 insertably engages and rotationally drives the top sash 12 frictional balance shoe 38 eccentric rotary cam 70*t* which operates within the sash shoe split 69 thereof to outwardly deflect the balance shoe feet 74 which thereupon frictionally engage the frame structure tracks and thereby retain said top sash 12 in a set vertically displaced vertical adjustment profile such as that demonstrated and shown in FIG. 4 by the window 10 cleaning mode position 36. Again, the coil springs 62 function as a block within the frame structure tracks 26 to limit the amount of downward vertical displacement by the cam operated frictional balance shoe 38, and thus the top sash 12**.

Return of the window 10 to the extended closed position 18 as shown in FIG. 1 is accomplished by manually displacing the top and bottom sashes 12 and 14 vertically so the respective sash shoes 38 and 24 in turn displace vertically within the frame structure tracks 26 to the window frame structure top 16T and bottom 16B ends whereupon the latching mechanism 20 deflects against the latch compression spring 78 and re-engages the latch keeper lug 76 within the lug retention opening 80, then with the top sash retaining pintle 34 manually re-inserted within the frame structure pintle retaining openings 88 therefor, the window 10 is again profiled in a secured and locked condition of the extended closed position 18.

Considering lastly the enlarged top sectional view of FIG. 5, which provides greater structural and functional detail of the latching mechanism 20. As shown, said mechanism 20 is adapted to be manually disengaged by finger hold upon the latch keeper handle 90 and with movement thereof from the latch keeper position **60*a* to the latch release position 60*b*, thus moving the latch keeper lug 76 to clear the lug retention opening 80, and thereby unlocking the window 10 from the extended closed position 18 for opening articulation to any of the various open mode positions. Upon closing of said window 10 the latching mechanism 20 automatically re-engages to the latch keeper position 60*a***.

Although the counterbalanced flex window invention hereof, the structural characteristics and method of employment thereof, respectively have been shown and described in what is conceived to be the most practical and preferred embodiment, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

I claim:

1. A counterbalanced flex window having a frame structure with an interior side and an exterior side within which are assembled a top sash and a bottom sash pivotally joined one to the other at the respective abutting ends thereof by an elongated sash frame joining hinge, said top sash and said bottom sash adapted to flex and fold one toward the other when said window is opened, said counterbalance flex window further comprising in combination a coil spring counterbalance assembly connected to said frame structure and in turn being interconnected to a bottom sash sash shoe which is adapted to be vertically slidable within a pair of frame structure tracks and automatically counterbalance said bottom sash when the same is profiled in a randomly opened disposition within said frame structure, a cam operated frictional balance shoe interconnected to said top sash and adapted to also be vertically slidable within said pair of frame structure tracks to automatically fix the adjusted placement set of said top sash in an opened disposition position within said frame structure, a latching mechanism adapted to release said top and bottom sashes for pivotal articulation, and a top sash retaining pintle adapted to be withdrawn and release said cam operated frictional balance shoe for vertically slidable displacement thereof within said pair of frame structure tracks.

2. The counterbalanced flex window according to claim 1 in which said latching mechanism is operable from said frame structure interior side.

3. The counterbalanced flex window according to claim 1 in which said coil spring counterbalance assembly embodies at least one counterbalance coil spring.

4. The counterbalanced flex window according to claim 3 in which said counterbalance coil spring is a constant force coil spring.

5. The counterbalanced flex window according to claim 1 in which said bottom sash shoe is a cam operated sash shoe.

6. The counterbalanced flex window according to claim 1 in which said window is provided with a retractable screen.

* * * * *